US008826468B2

(12) United States Patent
Harris

(10) Patent No.: US 8,826,468 B2
(45) Date of Patent: Sep. 9, 2014

(54) HELMET PADS

(71) Applicant: Philip R. Harris, Goshen, NY (US)

(72) Inventor: Philip R. Harris, Goshen, NY (US)

( * ) Notice: Subject to any disclaimer, the term of this patent is extended or adjusted under 35 U.S.C. 154(b) by 0 days.

(21) Appl. No.: 13/854,893

(22) Filed: Apr. 1, 2013

(65) Prior Publication Data

US 2013/0283504 A1 Oct. 31, 2013

Related U.S. Application Data

(60) Provisional application No. 61/638,922, filed on Apr. 26, 2012.

(51) Int. Cl.
*A42B 3/00* (2006.01)
*A42B 3/06* (2006.01)
*A42B 3/12* (2006.01)

(52) U.S. Cl.
CPC ..... *A42B 3/127* (2013.01); *A42B 3/069* (2013.01)
USPC ..... 2/411

(58) Field of Classification Search
USPC ..... 2/267, 411, 414, 412, 413, 410, 425
See application file for complete search history.

(56) References Cited

U.S. PATENT DOCUMENTS 2,849,758 A * 9/1958 Plumley et al. ..... 52/309.15
3,086,899 A * 4/1963 Ingraham et al. ..... 428/158
3,174,155 A * 3/1965 Pitman ..... 2/411
3,815,152 A * 6/1974 Bednarczuk et al. ..... 2/9
4,223,409 A * 9/1980 Lee ..... 2/411
4,660,230 A * 4/1987 Mayling ..... 2/413
4,937,888 A * 7/1990 Straus ..... 2/411
5,333,830 A * 8/1994 Millen ..... 248/679
5,461,730 A * 10/1995 Carrington ..... 2/411
5,732,414 A * 3/1998 Monica ..... 2/425
5,881,395 A * 3/1999 Donzis ..... 2/455
5,894,044 A * 4/1999 Norcom et al. ..... 428/116
5,894,045 A * 4/1999 Desrondiers ..... 428/178
5,953,762 A * 9/1999 Corbett ..... 2/425
6,101,636 A * 8/2000 Williams ..... 2/410
6,272,692 B1 8/2001 Abraham
6,282,724 B1 * 9/2001 Abraham et al. ..... 2/412
6,314,586 B1 11/2001 Duguid
6,360,376 B1 * 3/2002 Carrington ..... 2/412
6,519,781 B1 * 2/2003 Berns ..... 2/267
7,018,351 B1 * 3/2006 Iglesias et al. ..... 602/27
7,089,602 B2 * 8/2006 Talluri ..... 2/411
7,254,843 B2 * 8/2007 Talluri ..... 2/411
7,541,085 B2 * 6/2009 Burdon ..... 428/178
8,095,996 B2 * 1/2012 Turner ..... 2/456
8,438,669 B2 * 5/2013 Turner ..... 2/456
8,449,707 B2 * 5/2013 Simmons et al. ..... 156/219
8,561,214 B2 * 10/2013 Turner ..... 2/267
2004/0261157 A1 * 12/2004 Talluri ..... 2/412
2006/0070171 A1 * 4/2006 Copeland et al. ..... 2/455
2008/0172779 A1 * 7/2008 Ferguson ..... 2/455
2008/0184467 A1 * 8/2008 Brassill ..... 2/455
2009/0297756 A1 * 12/2009 Dehn ..... 428/68
2009/0307829 A1 * 12/2009 Onrot et al. ..... 2/465
2010/0186150 A1 * 7/2010 Ferrara et al. ..... 2/412

(Continued)

*Primary Examiner* — Alissa L Hoey
(74) *Attorney, Agent, or Firm* — Richard C. Litman

(57) ABSTRACT

Helmet pads are removably attached to the outer surface of an existing sport's helmet. The pads are constructed to conform to the contours of the outer surface of the helmet. The pads are made from layers of thermoplastic material structured to absorb both shock and acoustic waves that may cause concussive type injuries.

3 Claims, 3 Drawing Sheets

(56) References Cited

U.S. PATENT DOCUMENTS

2011/0047680 A1 3/2011 Hoying et al.
2011/0203036 A1* 8/2011 Turner et al. ..... 2/267
2012/0036619 A1* 2/2012 Ytterborn et al. ..... 2/411
2012/0151663 A1* 6/2012 Rumbaugh ..... 2/411
2013/0031700 A1* 2/2013 Wacter et al. ..... 2/411

* cited by examiner

HELMET PADS

CROSS-REFERENCE TO RELATED APPLICATION

This application claims the benefit of U.S. Provisional Patent Application Ser. No. 61/638,922, filed Apr. 26, 2012.

BACKGROUND OF THE INVENTION

1. Field of the Invention

The present invention generally relates to protective sportswear, and particularly to supplemental external helmet pads for a sports helmet.

2. Description of the Related Art

Protecting athletes from disabling injury has long been a primary focus for practitioners in the field of sports medicine and manufacturers of protective sportswear. The prevention of concussion injuries has been especially a target of discussion in view of recent findings regarding the long-term effects of such injuries. Athletes participating in sports, such as football, hockey, cycling, baseball, etc., whether professional or amateur, typically are required to wear helmets for protection in violent collisions or blows to the head. Waves (shock and acoustic) propagated by the aforementioned collisions and blows are thought to cause stress to the brain that may consequently produce concussions. Heretofore, helmets have been designed to protect the athlete from the effects of shock waves. No attention has been given to the effect of acoustic waves as a causative factor in concussive injuries. The need for a protective system that could be applied to existing helmet structure and that would be effective to absorb both shock and acoustic waves would be accepted eagerly in the art. Thus, helmet pads solving the aforementioned problem are desired.

SUMMARY OF THE INVENTION

The present invention is drawn to helmet pads that are removably attached to the outer surface of an existing helmet. The pads are constructed to conform to the contours of the outer surface of the helmet. The pads are structured to absorb both shock and acoustic waves. Each pad is constructed of layers of different thermoplastic foam materials, and includes layers designed to collapse to help absorb shock waves and acoustic waves that might otherwise produce head injuries resulting in stress to the brain.

Accordingly, the invention presents protective pads that can be quickly and easily attached to the outer surface of a conventional sports helmet. The pads provide supplemental protection against impacts that may cause concussive type injuries. The invention provides for improved elements thereof in an arrangement for the purposes described that are inexpensive, dependable and fully effective in accomplishing their intended purposes.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
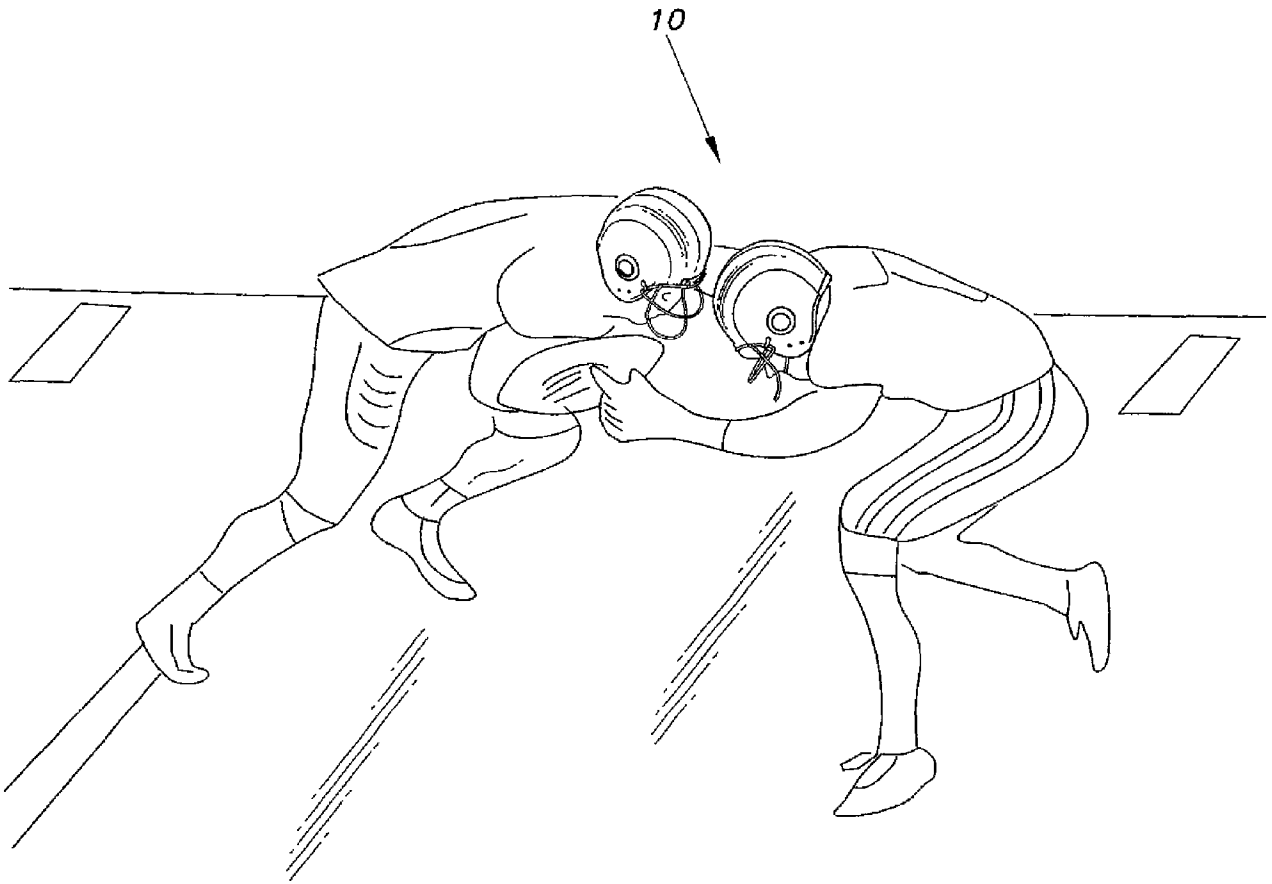
FIG. 1 is an environmental, perspective view of helmet pads according to the present invention.
Figure 2:
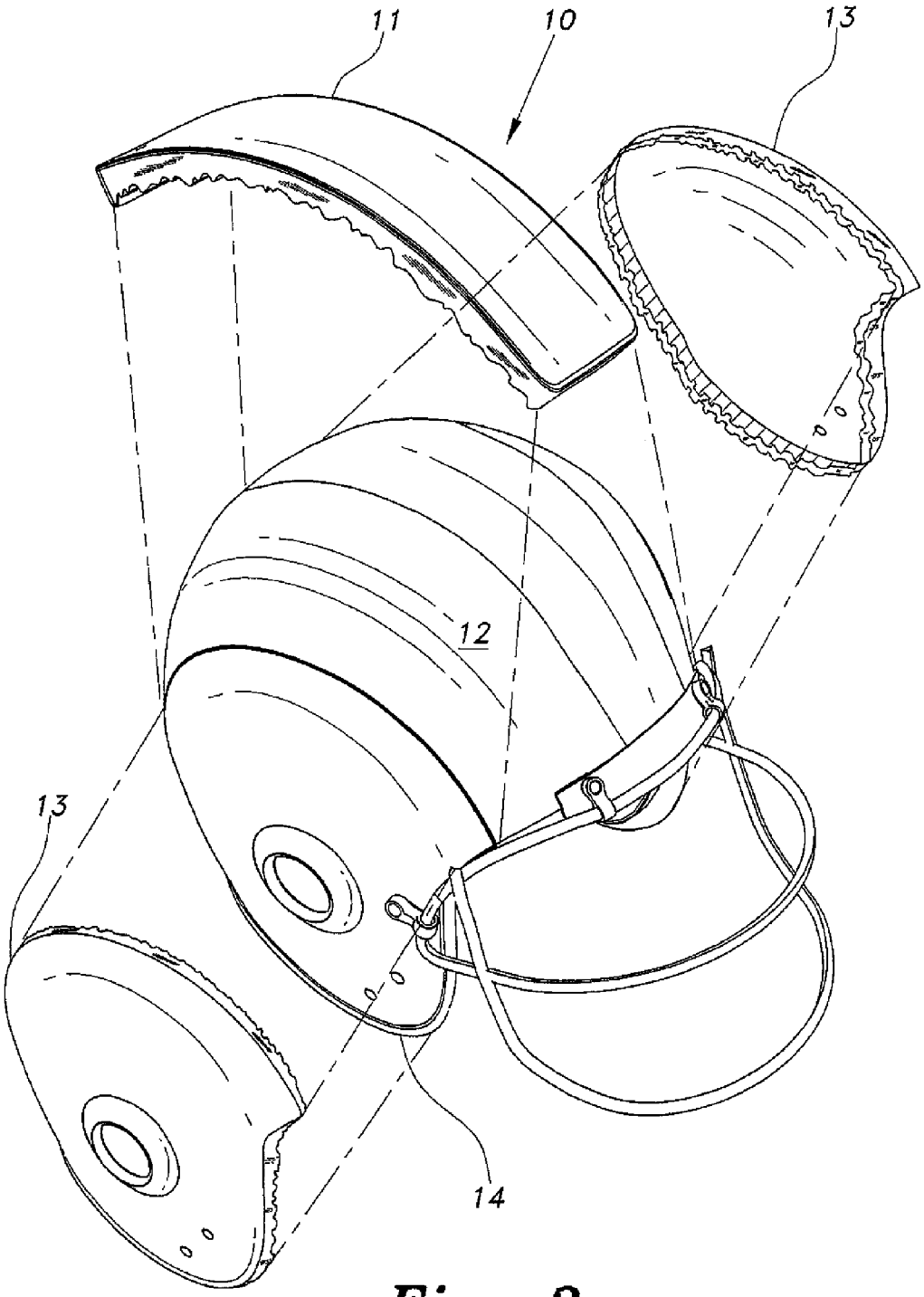
FIG. 2 is a partially exploded perspective view of helmet pads according to the present invention.
Figure 3:
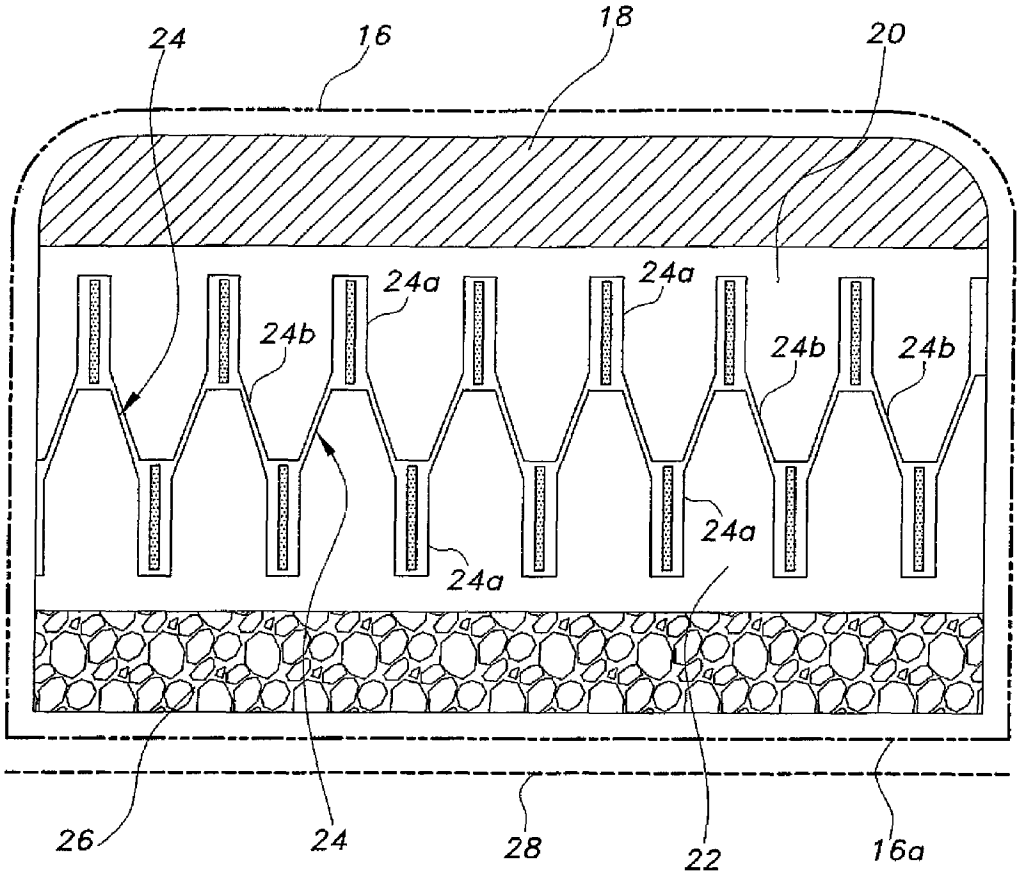
FIG. 3 is an end view, in section, of a helmet pad according to the present invention.

Referring to FIGS. 1-3 of the drawings, the helmet pads 10 include a top pad 11 and two side pads 13. The pads are adapted to be removably attached to the outer surfaces 12 of a conventional sports helmet 14. This arrangement permits the pads to be instantly adaptable to existing sport helmets without modification of the helmet structure. As indicated above, the pads 10 are designed to conform to the contours of the helmet 14 and may be configured in various patterns to cover the entire exterior surface of the helmet 14. Although, as illustrated, the helmet 14 is generally of the type used in football, it should be recognized that the pads 10 may be designed for any type (lacrosse, skating, cycling, etc.) of sports helmet. As presently contemplated, the pads will have a thickness ranging from 0.040 to 0.050 inches depending on the type of sport for which they are used.

As best seen in FIG. 3, each pad 10 is encased in a shell or outer layer 16 having a base 16*a*. The shell is fabricated from a suitable material, such as a silicon closed cell sponge, that would permit the shell to be painted or designed with school or team logos and/or colors, if desired. An outer layer of polypropylene or the like 18 is positioned immediately below the shell 16. First and second crumple zones are defined at 20 and 22. The crumple zones 20 and 22 are fabricated from polyvinyl chloride, or other suitable material that is extruded into a honeycombed configuration having alternating inverted V-shaped structures 24 encapsulated therein, the vertex of the V-shaped structures being formed as thick fingers 24*a* extending in opposite directions and thin, angled legs 24*b*, joining each finger to the next. The thin legs are engineered to fracture or crumple upon impact exceeding a predetermined threshold of force. The V-shaped structures 24 are fabricated from high-density polyethylene or the like, and are aligned against each other to create a folding zone when impacted. The crumple zones 20 and 22 create a stable platform that will absorb an impact equal to 250 lbs. of kinetic momentum before crumpling. Lesser impacts will produce no crumpling. A layer of high-density foam material 26, e.g., polyurethane, is disposed below and adjacent to the crumple zone 22 to absorb acoustical shock waves and limit exposure thereof to the helmet. Reference character 28 indicates an adhesive layer that is disposed along the exterior surface of the base of the pad 10, whereby the pad may be easily attached to the surface of the helmet 14. The adhesive layer 28 may be covered with conventional, removable release paper (not shown) when the pad 10 is not in use.

It is to be understood that the present invention is not limited to the embodiments described above, but encompasses any and all embodiments within the scope of the following claims.

I claim:

1. A helmet pad adapted for removable attachment to an outer surface of a helmet, comprising:

a central core, the central core including a honeycombed configuration having shock wave absorbing structure encapsulated therein, the central core being fabricated from polyvinyl chloride material extruded into a honeycombed configuration wherein the honeycombed configuration includes a plurality of alternating inverted V-shaped structures having vertices in the form of thick fingers extending in opposite directions and further including thin, angled legs joining each of the fingers to the next adjacent finger;

an inner layer disposed on one side of the central core, the inner layer being fabricated from a material for absorbing acoustic waves produced by the impacts on the helmet, the inner layer being fabricated from polyurethane foam material;

an outer layer disposed on a side of the central core opposite the inner layer, the central core being sandwiched between the inner layer and the outer layer, the outer layer being fabricated from polypropylene material;

a shell encasing the central core, the inner layer and the outer layer therein, the shell being fabricated from silicone closed-cell sponge material and having a base abutting the inner layer of foam material; and a layer of adhesive disposed on the shell base, the layer of adhesive being adapted for adhering the helmet pad to the helmet.

2. The helmet pad according to claim 1, wherein said shell base has an exterior surface and said layer of adhesive is disposed on the exterior surface.

3. The helmet pad according to claim 1, wherein said shock wave absorbing structure is fabricated from high-density polyethylene material.

* * * * *